US006156960A

United States Patent [19]

Abrams

[11] Patent Number: 6,156,960

[45] Date of Patent: Dec. 5, 2000

[54] STRINGED MUSICAL INSTRUMENT COMBINATION

[76] Inventor: Frank A. Abrams, 7730 SW. 118th St., Miami, Fla. 33156

[21] Appl. No.: 09/360,984

[22] Filed: Jul. 26, 1999

[51] Int. Cl.[7] ..... G10D 1/10

[52] U.S. Cl. ..... 84/269; 84/268; 84/418; 84/420; 84/270; 84/272; 84/294

[58] Field of Search ..... 84/268, 269, 418, 84/420, 267, 270, 272, 294

[56] References Cited

U.S. PATENT DOCUMENTS

| | | | |
|---|---|---|---|
| 1,384,843 | 7/1921 | Maxwell, Jr. | 84/171 |
| 4,213,368 | 7/1980 | Cox | 84/269 |
| 4,408,515 | 10/1983 | Sciuto | 84/267 |
| 4,469,001 | 9/1984 | Hartry | 84/269 |
| 4,549,462 | 10/1985 | Hartry et al. | 84/413 |
| 5,355,760 | 10/1994 | Bein et al. | 84/418 |
| 5,403,972 | 4/1995 | Valentine, Sr. | 84/730 |

*Primary Examiner*—David Martin
*Assistant Examiner*—Shih-yung Hsieh
*Attorney, Agent, or Firm*—Malloy & Malloy, P.A.

[57] ABSTRACT

A new stringed musical instrument having an appearance somewhat similar to a banjo or guitar or related instrument and comprising a head portion and an elongated neck secured to the head portion and extending outwardly therefrom. A plurality of strings, which may vary in number, extend across and in overlying relation to an outer face of the head portion and continuously therefrom along the length of the neck, where they are adjustably attached by individual, rotatably mounted pegs. The head portion preferably comprises a tambourine having an exposed outer face and an inner face and a flexible material membrane stretched in a taut orientation across the exposed outer face and in underlying relation to the plurality of strings. The tambourine head portion also includes a plurality of metal disks or "jingles" movably mounted on the peripheral sidewall thereof. The neck and plurality of strings are cooperatively disposed and structured with the tambourine, such that different musical sounds representative of a banjo or like stringed instrument and a tambourine, may be independently or concurrently produced upon respective manipulation of the strings and/or tambourine by a player of the instrument.

23 Claims, 2 Drawing Sheets

STRINGED MUSICAL INSTRUMENT COMBINATION

BACKGROUND OF THE INVENTION

1. Field of the Invention

This invention relates to a new musical instrument. More in particular, the present invention primarily relates to a stringed musical instrument, such as, but not limited to, an instrument of the banjo or guitar family, which includes a head portion comprising a tambourine. Secured to the head portion is an elongated neck which extends outwardly therefrom and a plurality of elongated strings. The elongated strings, which may vary in number consistent with a banjo, guitar or ukelele, extend diametrically across and in spaced, overlying relation to an outer face of the head portion and continuously along the length of the elongated neck to a location where they are adjustably anchored adjacent the distal end of the neck. When played, the musical instrument of the present invention produces sound, either concurrently or independently, representative of both the stringed instrument and the tambourine.

2. Description of the Related Art

For many years, it has been the desire of various musicians to generate a variety of different but complimentary musical sounds in an effort to enhance a musical composition being played. Of course, different musical sounds can be generated by the successive playing of various individual musical instruments, although this practice does not afford an ability to concurrently produce a host of complimentary musical sounds representative of different musical instruments. This drawback is easily overcome by the collection of a plurality of musicians each performing on a different musical instrument while concurrently playing the same musical composition in an intended, orchestrated manner.

However, the grouping of a plurality of individuals in relatively small numbers, such as in a band, or in greater numbers, such as in an orchestra, does not satisfy the desire of a single musician who wishes to offer greater versatility in his performance of a single composition. To achieve such greater versatility, some musicians have devised ways to group together individual musical instruments in a relatively complicated manner so as to offer a "one man band." However, the known types of one-man bands typically require the musician to mount and/or carry a plurality of different musical instruments on his or her body and/or to locate them in close proximity to his or her arms and legs. For example, one the perhaps most unique attempts of a single musician to combine a plurality of musical sounds might involve the wearing of an accordion or a guitar strapped about the upper torso, as well as a device worn about the neck to carry a harmonica near the musician's mouth for selective playing thereof, as well as a set of drums and/or cymbals on a stand, either or both of which can be operated by a foot pedal, wherein each of these musical instruments can be concurrently or successively played by the single musician using different parts of his or her body. While such one-man bands may be a desirable way of providing a greater variety of musical sounds in the performance of a single composition, they have appeal to relatively few musicians, due at least in part to the unusual skills required to coordinate the simultaneous operation of several different musical instruments.

Other efforts to permit a single musician to achieve greater versatility in performing a single composition include the innovation of musical synthesizers. There are several types of synthesizers that are readily available to musicians, and while these are not necessarily difficult to operate, they are nevertheless highly sophisticated and electronically complex, due at least in part, to advancements in micro-circuitry and the digital reproduction, storage and groupings of sounds from a variety of musical instruments. Such synthesizers can be mounted on and/or used in combination with many different types of musical instruments, and as indicated above, the operation of such synthesizers is accomplished electronically and results in the generation of synthesized musical sounds representative of almost any type of conventional musical instrument. While such synthesizers are sophisticated and apt to satisfy a single musician's desire to produce a variety of combined musical sounds, they may still be considered impractical for the amateur musician due to expense as well as the ability to learn how to operate them. For some other musicians, however, synthesizers may even be considered somewhat undesirable as the musical sounds produced by them are not truly authentic in that they do not entirely originate with the musician, himself or herself.

Accordingly, there remains a need in the art relating to music for a new musical instrument which is capable of originally producing musical sound representative of more than one conventional instrument, and further, wherein the quality of the sound produced accurately represents the sound produced by conventional, individual instruments. If any such new musical were developed, it should also be relatively simple in terms of its structure and design, and further, should be easy to utilize in a manner which would either concurrently or independently produce the intended, different musical sounds, such as by the manipulation of the instrument and/or portions thereof by the musician while playing a single musical composition.

SUMMARY OF THE INVENTION

The present invention is intended to address these and other needs which remain in the art and is directed towards a musical instrument which, when played, can generate a plurality of original musical sounds. More in particular, the musical instrument of the present invention can generate a plurality of musical sounds such as those which are normally generated by a conventional banjo, guitar, ukelele or other type of stringed instrument and also by a conventional tambourine.

The musical instrument of the present invention comprises a head portion and an elongated neck fixedly secured or otherwise coupled and/or connected to the head portion and extending outwardly therefrom. A plurality of strings, which may vary in number but which preferably are either 4, 5 or 6 strings, are secured to both the head portion and the neck and are of a length sufficient to extend diametrically across an outer face of the head portion and along at least a majority of the length of the neck. Preferably, the strings are adjustably mounted to the outer or distal end of the elongated neck and are connected thereto by rotationally mounted pegs of the type typically found on banjos, guitars and like stringed musical instruments, to permit the independent adjustment of tension applied to individual ones of the strings.

The head portion of the musical instrument according to the present invention comprises a tambourine structure. More specifically, the head structure is preferably defined by a substantially annularly configured sidewall or ring which may include an open outer face and an open inner face both of which communicate with a hollow interior. The outer and inner faces may be distinguishable from one another by the outer face being exposed, when the instrument is disposed in a normal operative or playing orientation. On the other hand, the inner face of the head portion is disposed in facing or substantially confronting relation to the player's body when the instrument is in the conventional playing position. The outer, exposed face is more preferably defined as including a flexible material or membrane formed from any one of a variety of different materials which are applicable for use in covering the head portion of a conventional banjo or other musical instrument, such as a tambourine. The flexible material covering is disposed in overlying, covering relation to the open outer face of the head portion and is secured about the annular sidewall thereof, preferably at the periphery thereof, in a manner which orients the flexible material covering in a substantially taut, tightly stretched orientation. As set forth above, the plurality of strings extend diametrically across the outer face of the head portion and are preferably spaced substantially above or outwardly from the flexible material covering.

The head portion of the musical instrument according to the present invention preferably also comprises a plurality of metal disks, commonly referred to as "jingles" which are structured and disposed to generate the musical sounds of a tambourine. Each of the plurality of metal disks is preferably secured to the annular sidewall of the head portion in spaced relation to one another along the substantially continuous length of the sidewall. Also, the plurality of jingles are preferably arranged in pairs, wherein each pair extends transversely through a pre-formed opening or aperture formed in the sidewall, such that the pair of metal disks or jingles extend partially into the hollow interior of the head portion and partially outwardly from an exterior surface of the sidewall of the head portion. In addition, each pair of the plurality of jingles is movable relative to one another, so as to repeatedly contact one another upon a manipulation of the head portion, such as by the musician's tapping or knocking on the flexible material covering of the head portion or shaking of the head portion itself. Such manipulation will serve to generate the desired jingling musical sound associated with a tambourine, and could also generate a drum-like beat if the player of the instrument repeatedly taps or beats on the flexible material covering.

Therefore, the musical instrument of the present invention is capable of generating sounds which are associated with a conventional banjo, guitar or related stringed musical instrument similar and either concurrently or independently of generating the plurality of jingling sounds associated with a conventional tambourine, as well as possibly drum-like knocking sounds. However, the musical instrument of the present invention has the advantage of allowing a musician to produce such musical sounds while playing or performing on a single instrument, rather than being subjected to the inconvenience of switching instruments and/or sacrificing spontaneity by playing only one conventional instrument in the performance of a musical composition. Further, the musical instrument of the present invention overcomes the practical disadvantages of forcing the musician to purchase an expensive electronic synthesizer in order to produce a variety of combined sounds on a concurrent or independent basis.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
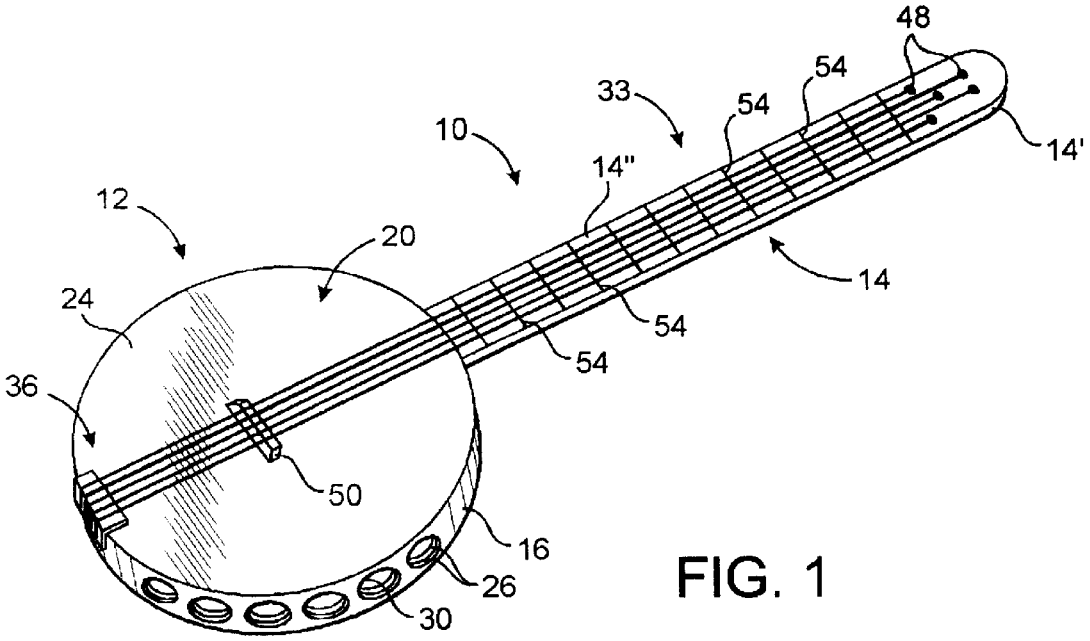
FIG. 1 is a perspective view of a musical instrument according to the present invention in a preferred embodiment.

The present invention is directed towards a musical instrument which, in the accompanying drawings is generally indicated as 10. The musical instrument 10 includes a head portion, generally indicated as 12, and an elongated neck generally indicated as 14. The elongated neck 14 is preferably, but not necessarily, fixedly secured to the head portion 12 and extends outwardly therefrom, as shown in FIGS. 1 and 2.

The head portion 12 comprises a generally annularly configured sidewall 16 having a continuous length disposed in surrounding relation to a hollow interior 18. The head portion 12 further includes an outer, exposed face 20 and an inner face 22. In one possible embodiment, both the outer face 20 and the inner face 22 may be open and in fluid communication with the hollow interior 18. However, the outer, exposed face 20 is preferably further defined by a flexible material covering or membrane 24 mounted in overlying, covering relation to the open outer face 20 so as to define an exposed surface of the outer face 20. Further, the flexible material covering or membrane 24 is preferably mounted substantially about the periphery of the annular sidewall 16 in a tightly stretched or taut orientation by a plurality of rivets or like connectors 25, shown in FIG. 3. The physical characteristics of the flexible material covering or membrane 24 and its secured mounting in a tightly stretched orientation over the outer face 20 enables a player or musician to repeatedly tap on, beat, knock on or otherwise apply manual pressure or manipulation thereto. The taut orientation and attachment of the membrane 24 may therefore resemble in some embodiments the head of a drum. Such manual manipulation of the head portion 12, and the membrane 24 in particular, may therefore produce an intended, drum-like beat from the musical instrument 10, which is only one possible musical sound it may produce, as will be explained in greater detail hereinafter.

Figure 2:
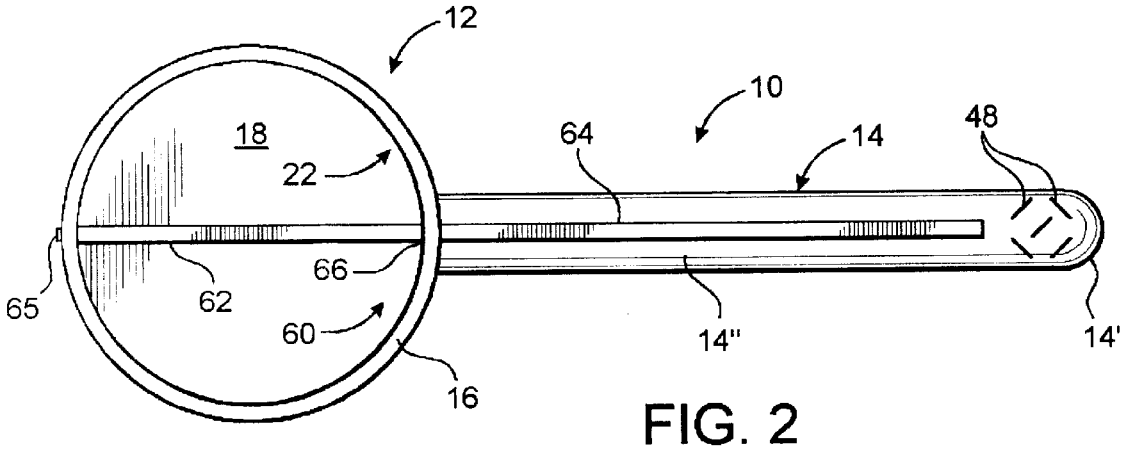
FIG. 2 is a bottom view of the embodiment of FIG. 1.
Figure 6:
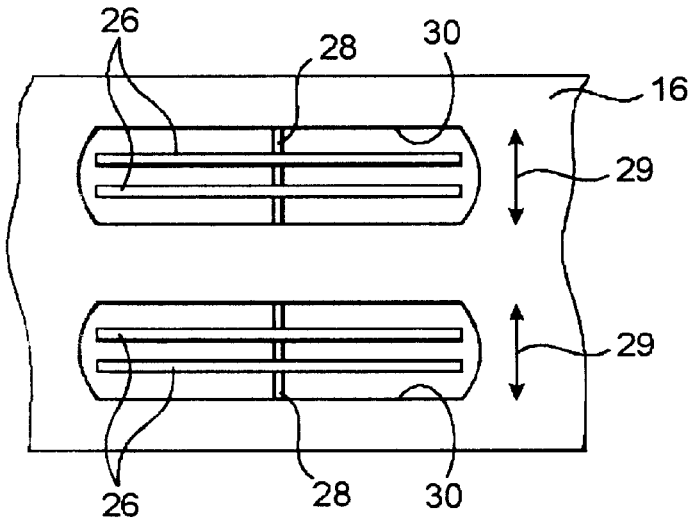
FIG. 6 is a side detailed view of a part of the head portion of the present invention.

As shown in FIG. 1, the head portion 12 further comprises a plurality of disks 26, preferably made at least in part of a metallic material. With reference to FIG. 6, the plurality of disks 26 are preferably, but not necessarily, arranged in pairs which are movably mounted so as to be movable relative to one another, wherein each of the metal disks 26 are both rotatably and reciprocally attached to a centrally disposed spindle 28. The spindle 28 is preferably mounted within each of a plurality of openings 30 formed in a predetermined pattern which extends substantially continuously along the sidewall 16. The metal disks 26 are movable relative to one another, in a manner indicated by directional arrows 29, so as to continuously and repetitively come into contact with one another when the instrument 10, and more particularly, the head portion 12 is manipulated in the proper manner such as by beating on the membrane 24 and/or shaking the head portion. The disks 26 are more conventionally known as "jingles" due to the fact that the sound generated by the repetitive contact of the metallic disk pairs produce a jingling musical sound. As shown in FIG. 6, one embodiment of the present invention shows at least two pairs of the jingles 26 arranged in a spaced apart, somewhat stacked array, and further, wherein the two pairs of stacked jingles 26 are disposed in spaced relation to one another. The orientation of the jingles 26 and their transverse dimension is preferably such that each of the jingles 26 extends partially into the hollow interior 18 of the head portion 12 and also extends partially outwardly from the annular sidewall 16.

Figure 3:
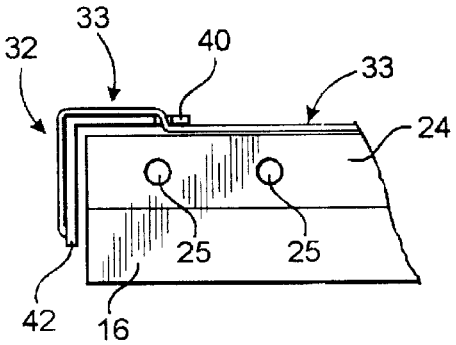
FIG. 3 is a detailed side view in partial cutaway of a connector member for anchoring the plurality of strings on the instrument of the present invention.
Figure 4:
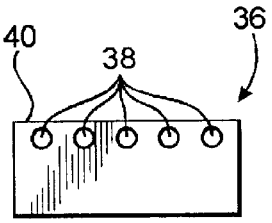
FIG. 4 is a top view of the embodiment of FIG. 3.
Figure 5:
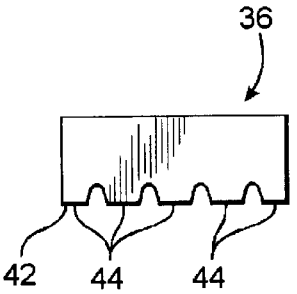
FIG. 5 is an end view of the embodiment of FIGS. 3 and 4.

The musical instrument 10 of the present invention further comprises a plurality of strings, collectively indicated as 33, each having a sufficient length or longitudinal dimension to be attached to both the head portion 12 and the neck 14. More specifically, one end of each of the plurality of strings 33 is preferably secured to an exterior portion of the head portion, and more preferably, to a trailing end of the head portion 12 by a connector member, generally indicated as 36, as is shown in FIG. 1. However, as best shown in FIGS. 3 and 4, the connector 36 includes a plurality of spaced apart apertures 38 extending through and along a leading end 40 of the connector 36. The trailing end 42 of the connector 36, as best shown in FIG. 5, includes a plurality of spaced apart fingers 44. With reference to FIG. 3, the individual ones of the plurality of strings 33 preferably extend diametrically across the outer face 20 of the head portion 12 and through individual ones of the plurality of apertures 38. The corresponding extremities or ends of the strings 33 are then looped about or otherwise secured to the individual ones of the plurality of fingers 44, subsequent to their passage through the apertures 38 as represented in FIGS. 3 and 4. With reference to FIG. 2, the opposite end of each of the plurality of strings 33 are adjustably secured to one of a plurality of rotatably mounted adjusting pegs, 48, received within sockets or apertures (not shown) in the outer or distal end 14' of the neck 14. Rotation of the individual pegs 48 serves to adjust the tension on individual ones of the plurality of strings 33, and therefore, the tone of the musical sound that each is capable of producing, in somewhat of a conventional manner.

Referring again to FIG. 1, another structural feature of the musical instrument 10 will preferably include the provision of an outwardly projecting bridge 50 secured to the outer surface of the flexible material covering or membrane 24, such as by adhesive or other applicable means. The bridge 50 is structured and disposed to support an intermediate portion of each of the plurality of strings 33 so as to maintain the strings 33 in outwardly spaced relation to the exterior surface of the membrane 24.

In one embodiment, the musical instrument 10 according to the present invention may include the outer surface 14" of the neck 14 having an overall smooth configuration. Alternatively, the outer surface 14" of the neck 14 may include a plurality of spaced apart frets 54 which aid in the musician in fingering the individual strings 33 to generate a musical sound in a desired note or tone. Accordingly, proper manipulation of the strings 33 by the musician may cause the musical instrument 10 to produce a sound that is typically associated with a conventional banjo, guitar, ukelele or like stringed musical instrument.

Figure 7:
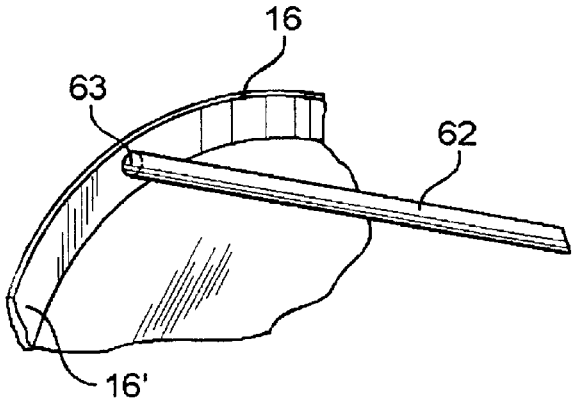
FIG. 7 is a detailed view in perspective and partial cut away of an interior of a head portion of the combined musical instrument of the present invention.
Figure 8:
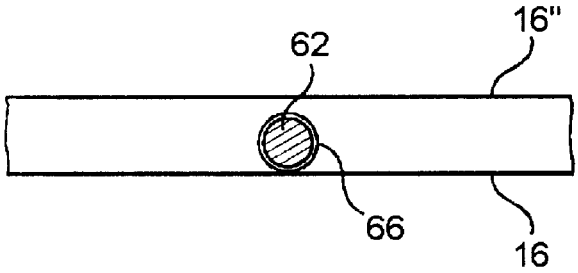
FIG. 8 is a front detailed view in partial cut away of the interior of the head portion of the embodiments of FIGS. 1 and 2.

With reference to FIGS. 2, 7, and 8, the musical instrument of the present invention may also include a brace structure, generally indicated as 60. The brace structure 60 preferably has an elongated configuration including a first length 62 having one end 63 secured to the inner surface 16' of the sidewall 16 generally adjacent to a trailing end of the head portion 12. Attachment of the end 63 of the first length 62 can be accomplished through the provision of a screw or other equivalent connector 65 passing through a portion of sidewall 16 and fixedly engaging the end 63 in somewhat of a coaxial relation thereto. Alternatively, some types of tambourines include an annular aperture in the sidewall 16, which if used as a foundation for the head member 12, can be oriented relative to the neck 14 so as to receive and anchor the end 63 of the brace structure 60 therein in parallel, aligned relation to the neck 14. The elongated brace structure 60 also includes a second length 64 which extends along a length of the neck 14, and preferably, a substantial portion thereof, and further, is attached to an undersurface portion 14"' thereof. Attachment of the brace structure 60, and in particular, the second length 64 to the undersurface 14"' may be by any applicable means including adhesive, screw type connectors or other connecting devices. Preferably, and with reference to both FIGS. 7 and 8, the elongated brace structure 60 is of a unitary, one piece construction and may be in the form of a wooden dowel or other dowel like structure formed of a suitably rigid material. In this preferred embodiment, the dowel extends continuously across the diameter of the hollow interior 18 of head portion 12 and therefrom, through a preformed aperture 66 in the sidewall 16, as noted above, and in fixed engagement with the under surface 14"' of the neck 14. From the foregoing, it should be readily apparent that the head portion 12 is most preferably defined by a conventional tambourine or a tambourine like structure, and that the overall instrument, including cooperative disposition and structuring of the head portion 12 and the neck 14, generally resembles a banjo, guitar, ukelele or like stringed musical instrument.

Since many modifications, variations and changes in detail can be made to the described preferred embodiment of the invention, it is intended that all matters in the foregoing description and shown in the accompanying drawings be interpreted as illustrative and not in a limiting sense. As one example only, it is contemplated that the head portion of the musical instrument may not have a flexible material covering the open face, in which case the brace structure might be eliminated or otherwise modified. As such, the scope of the invention should be determined not just be the drawings and the foregoing description, but by the appended claims and their legal equivalents.

Now that the invention has been described,

What is claimed is:

1. A musical instrument comprising:

a) a head portion and an elongated neck secured to said head portion and extending outwardly therefrom, b) a plurality of strings secured to both said head portion and said neck and extending along the length of said neck and diametrically across said head portion, c) a plurality of disks mounted on said head portion in spaced apart relation about an outer periphery thereof, and d) said head portion and said neck cooperatively disposed to facilitate the generation of different musical sounds upon the manipulation of said strings and said head portion respectively, when the instrument is oriented and played in an operative position.

2. A musical instrument as recited in claim 1 wherein said head portion comprises an annularly configured sidewall.

3. A musical instrument as recited in claim 2 wherein said head portion further comprises an open outer face and an open inner face.

4. A musical instrument as recited in claim 3 wherein said head portion further comprises a flexible material mounted in overlying, covering relation to said open outer face.

5. A musical instrument as recited in claim 4 wherein said plurality of strings are disposed in overlying, spaced relation to said flexible material and said outer face.

6. A musical instrument as recited in claim 5 wherein said membrane is stretched taut across said outer face.

7. A musical instrument as recited in claim 4 wherein a plurality of jingles are movably mounted on said sidewall and oriented in transverse relation to said sidewall, said plurality of jingles extending both into said hollow interior and exteriorly of said sidewall.

8. A musical instrument as recited in claim 7 wherein said plurality of jingles are arranged in a plurality of pairs, each jingle of each pair movable relative to one another into and out of engagement with one another.

9. A musical instrument as recited in claim 8 wherein said plurality of jingles are at least partially disposed in spaced apart columns, each column including two, spaced apart jingle pairs, each jingle of each pair comprising a metal material disk.

10. A musical instrument as recited in claim 1 wherein said head portion comprises a sidewall disposed in substantially surrounding relation to a hollow interior.

11. A musical instrument as recited in claim 10 further comprising a brace structure including a first length secured to said head portion and mounted within said hollow interior.

12. A musical instrument as recited in claim 11 wherein said brace structure comprises a second length extending outwardly from said sidewall and along a length of said neck.

13. A musical instrument as recited in claim 12 wherein said brace structure comprises an elongated configuration of sufficient dimension to extend continuously from an interior surface of said sidewall diametrically across said hollow interior and outwardly from said sidewall continuously along at least a majority of the length of said neck.

14. A musical instrument as recited in claim 13 wherein said brace structure is secured to an undersurface of said neck.

15. A musical instrument as recited in claim 14 wherein said brace structure comprises an elongated dowel of unitary, one piece construction.

16. A musical instrument as recited in claim 15 wherein said head portion further comprises an open outer face and an open inner face and a flexible material membrane mounted in a taut, overlying relation to said outer face.

17. A musical instrument as recited in claim 1 wherein said head portion comprises a tambourine.

18. A musical instrument as recited in claim 17 wherein said head portion comprises a sidewall disposed in substantially surrounding relation to a hollow interior, and further comprising a brace structure including a first length secured to said head portion and mounted within said hollow interior.

19. A musical instrument as recited in claim 18 wherein said brace structure comprises a second length secured to said neck and extending outwardly from said sidewall and along a length of said neck.

20. A musical instrument as recited in claim 10 wherein said brace structure comprises an elongated configuration of sufficient dimension to extend continuously from an interior surface of said sidewall diametrically across said hollow interior and continuously along at least a majority of the length of said neck.

21. A musical instrument as recited in claim 20 wherein said brace structure is secured to an undersurface of said neck and comprises and elongated dowel of unitary, one piece construction.

22. A combined musical instrument comprising:

a) a head portion and an elongated neck fixedly secured to said head portion and extending outwardly therefrom, b) a plurality of strings secured to both said head portion and said neck and extending along the length of said neck and diametrically across said head portion, c) said head portion comprising a tambourine having a hollow interior and including an outer face and an inner face, d) said outer face including a flexible material membrane having a taut orientation extending in covering relation to said outer face, e) a plurality of jingles movably mounted about a periphery of said tambourine; and f) said neck and plurality of strings cooperatively attached and structured with said tambourine to concurrently or independently produce different musical sounds upon respective manual manipulation of said plurality of strings and said tambourine.

23. A combined musical instrument as recited in claim 22 comprising a brace structure having an elongated configuration of sufficient dimension to extend continuously from an interior surface of said sidewall diametrically across said hollow interior and continuously along at least a majority of the length of said neck.

* * * * *